US005435463A

United States Patent [19]

Hodgson

[11] Patent Number: 5,435,463

[45] Date of Patent: Jul. 25, 1995

[54] CONDIMENT DISPENSER

[75] Inventor: Dale A. Hodgson, Mequon, Wis.

[73] Assignee: DCI Marketing, Milwaukee, Wis.

[21] Appl. No.: 173,372

[22] Filed: Dec. 23, 1993

[51] Int. Cl.[6] ..... B67D 5/06

[52] U.S. Cl. ..... 222/105; 222/182; 222/207; 222/214; 222/405

[58] Field of Search ..... 222/105, 182, 207, 214, 222/325, 340, 383, 405

[56] References Cited

U.S. PATENT DOCUMENTS

| | | | |
|---|---|---|---|
| 2,113,022 | 4/1938 | Hefti | 222/207 |
| 3,066,832 | 12/1962 | Rossetti | 222/207 |
| 3,905,520 | 9/1975 | Nishioka | 222/383 X |
| 3,952,924 | 4/1976 | Benson | 222/181 |
| 4,098,434 | 7/1978 | Uhlig | 222/94 |
| 4,120,429 | 10/1978 | Vignot | 222/207 |
| 4,147,278 | 4/1979 | Uhlig | 222/94 |
| 4,193,513 | 3/1980 | Bull, Jr. | 222/1 |
| 4,256,242 | 3/1981 | Christine | 222/207 |
| 4,349,133 | 9/1982 | Christine | 222/207 X |
| 4,886,192 | 12/1989 | Cassia | 222/207 X |
| 4,895,276 | 1/1990 | Matdonado | 222/214 X |
| 4,961,508 | 10/1990 | Weimer et al. | 222/207 X |
| 4,978,036 | 12/1990 | Burd | 222/207 |
| 5,033,653 | 7/1991 | Kaufman | 222/185 |
| 5,125,434 | 10/1992 | Birmelin | 222/207 |
| 5,217,147 | 6/1993 | Kaufman | 222/185 |

FOREIGN PATENT DOCUMENTS

| | | | |
|---|---|---|---|
| 0285742 | 10/1988 | European Pat. Off. | 222/214 |

*Primary Examiner*—Andres Kashnikow
*Assistant Examiner*—Lisa Douglas
*Attorney, Agent, or Firm*—Michael, Best & Friedrich

[57] ABSTRACT

A condiment dispenser apparatus including a housing and a replaceable dispenser insertable into the housing. The dispenser includes a collapsible condiment bag and a pump apparatus attached to the bag for pumping condiment from the bag. The pump apparatus includes a pump actuating member that is supported for linear movement by a bracket on the housing. To move the pump actuating member to operate the pump apparatus a manually operable lever is supported for pivotal movement on a cover for the housing. When the cover is closed the lever is automatically brought into engagement with the pump actuating member so that depression of the lever operates the pump to dispense condiment. When the dispenser is empty it is discarded and replaced with a new dispenser.

19 Claims, 4 Drawing Sheets

CONDIMENT DISPENSER

BACKGROUND OF THE INVENTION

1. Field of the Invention

The invention relates generally to fluid material dispensers, and more particularly to dispensers including manually operable pumping mechanisms.

2. Reference to Prior Art

Manually operated condiment dispensers are commonly used in restaurants, food stands and in commercial food preparation applications to dispense ketchup, mustard, etc. A known dispenser includes a manually operable pump for dispensing condiment from a container through a spout. Typically, a single pump stroke dispenses a metered amount of condiment equal to a single serving size portion.

SUMMARY OF THE INVENTION

The invention provides an improved dispenser apparatus which can be economically produced and maintained and easily operated to dispense condiment or other fluid material. The dispenser apparatus includes a housing and a dispenser having a condiment container that can, when empty, be quickly and conveniently replaced with a minimum of time and effort. The dispenser also includes a pump apparatus that is automatically made operational to pump condiment from the container by closing the housing. When the supply of fluid in the container is depleted, the entire dispenser (or just the container if the pump apparatus is to be reused) can be discarded as a self-contained unit without attenuant mess or clean-up. The discarded dispenser is then replaced with a full one, and the pump apparatus in the full dispenser is automatically operational upon closing the housing.

More particularly, the invention provides a dispenser apparatus including a housing that defines a compartment, and a dispenser that is insertable into the compartment. The dispenser includes a pump apparatus and a fluid reservoir or container such as a collapsible bag supported in a cardboard box for example. In one embodiment, the pump apparatus includes an inexpensive bellows-type pump permanently mounted on the container and a spout through which condiment is dispensed. When the container is empty, the dispenser including the pump apparatus and container is discarded as a unit and replaced with a new one. Alternatively, the pump apparatus can be more durably constructed and reused with subsequent containers.

To support the dispenser within the housing, the housing is provided with a wall having an opening defined by a lip and a set of brackets. The lip and brackets hold the pump apparatus in an operable position so that the pump apparatus can be actuated via movement of a pump actuating member. The pump actuating member is supported on a guide member including brackets and movement of the pump actuating member is guided by elongated slots in the brackets. The slots limit the pump actuating member to linear movement parallel to the pump axis. By so limiting pump actuating member movement, pump wear and improper or inadequate pump performance are minimized. For example, when the abovementioned bellows-type pump is employed, strictly linear movement of the pump actuating member reduces the possibility that the bellows will "cock" during operation. Such cocking or eccentric operation of the bellows could cause the bellows to develop leaks and thereby become inoperative or to dispense less than the desired amount of condiment per pump stroke.

To operate the pump actuating member, a pump actuating lever is mounted on the housing for pivotal movement relative thereto. When the housing is closed, the lever is automatically brought into operative engagement with the pump actuating member so that the pump apparatus is operated by pressing on the lever. To translate the pivotal lever movement into linear movement of the pump actuating member, the lever is provided with arcuate slide surfaces that slidably engage the pump actuating member to form a lost motion connection therebetween.

The invention also provides a condiment dispenser apparatus including a housing which defines upper and lower compartments and which includes a top wall separating those compartments. The housing includes a front wall moveable between opened and closed positions to gain or restrict access to the lower compartment, and a cover moveable between opened and closed positions to gain or restrict access to the upper compartment. The condiment dispenser apparatus also includes a replaceable dispenser having a collapsible bag for containing condiment. The collapsible bag is housed in the lower compartment and is provided with an attached pump apparatus. The pump apparatus includes a bellows pump that extends upwardly into the upper compartment through an opening in the top wall. The bellows pump includes a bellows defining a pumping chamber that is expandable to draw condiment from the collapsible bag into the pumping chamber and contractible to dispense condiment from the pumping chamber through a spout. The bellows pump is also provided with a disk that is assembled in snap-fit relation in a mounting member for movement therewith to form a pump actuating member. The mounting member is supported for vertical movement by a pair of spaced apart brackets on opposite sides of the opening in the top wall. Each of the brackets includes an elongated vertical slot, and projections from the mounting member extend through those slots to limit movement of the pump actuating member to vertical movement.

To actuate vertical movement of the pump actuating member to operate the bellows pump, a manually operable lever mounted on the cover of the housing for pivotal movement about a horizontal axis is provided. The lever is operable to depress the pump actuating member to contract the bellows. In particular, the lever includes a pair of downwardly facing arcuate slide surfaces which engage the projections on the pump actuating member when the cover of the housing is closed. To expand the bellows after it has been contracted to expel condiment, a spring-biased pivot member is provided on the brackets. The pivot member includes a pair of spaced apart arms each having an elongated slot through which one of the projections on the pump actuating member extends. When the lever is released after being depressed, the pivot member raises the pump actuating member to expand the bellows.

Various other features and advantages of the invention will become apparent to those skilled in the art upon review of the following detailed description, claims and drawings.

Figure 1:
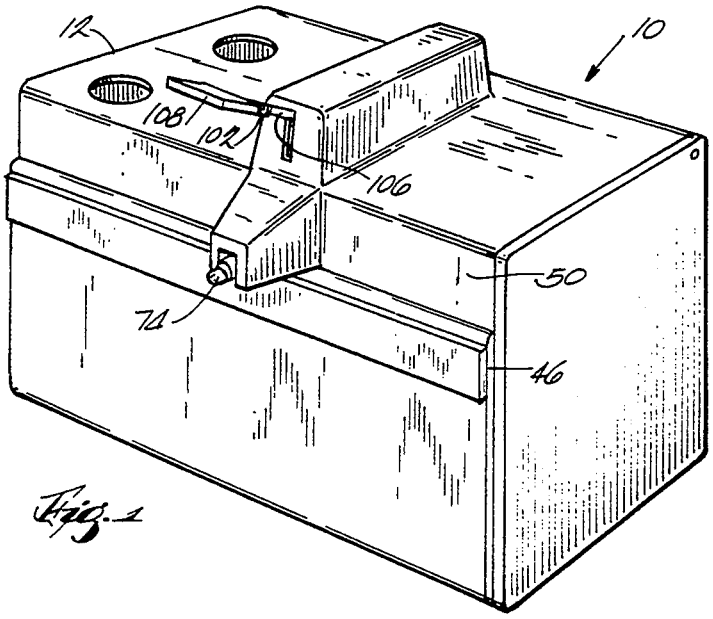
FIG. 1 is a perspective view of a dispenser apparatus which embodies the invention and which is shown with the dispenser housing closed.

Before one embodiment of the invention is explained in detail, it is to be understood that the invention is not limited in its application to the details of construction and the arrangement of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF A PREFERRED EMBODIMENT

Illustrated in FIG. 1 is a dispenser apparatus 10 for dispensing a fluid material. In the illustrated arrangement, the dispenser apparatus 10 is used for dispensing a food product such as a condiment (i.e., ketchup, mustard, etc.) and will be described in association with such usage.

Figure 2:
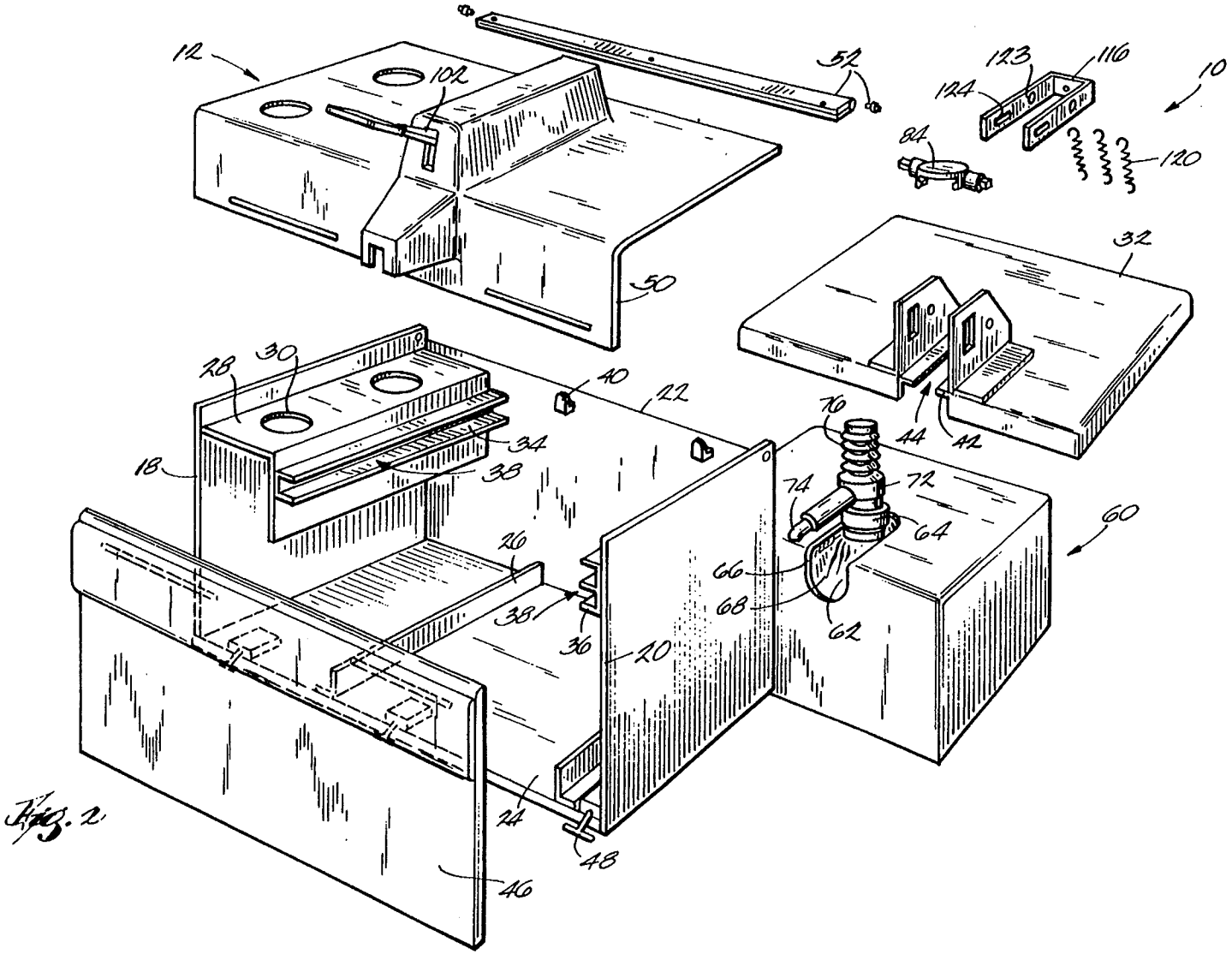
FIG. 2 is an exploded perspective view of the dispenser apparatus illustrated in FIG. 1.
Figure 3:
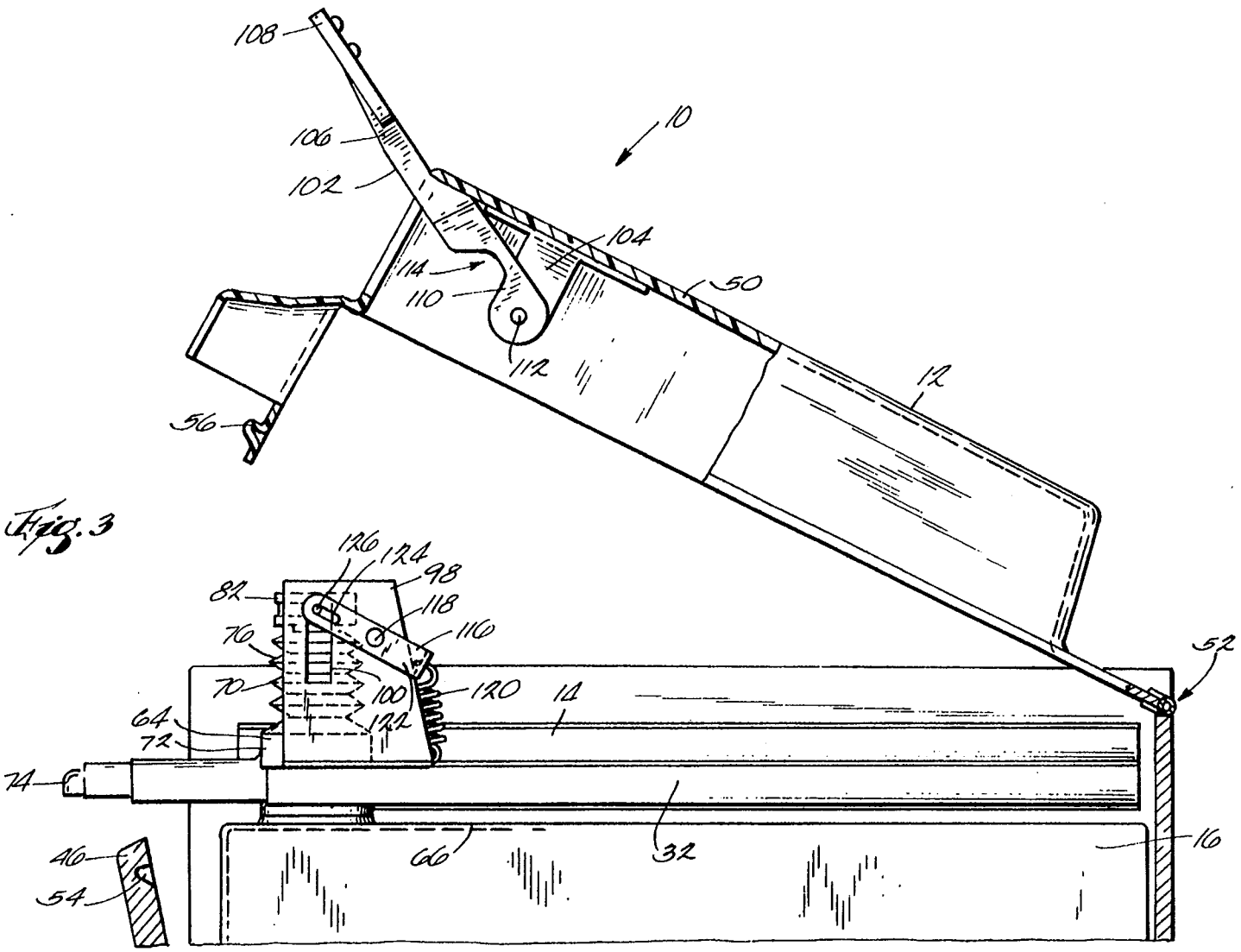
FIG. 3 is an enlarged, partially cross-sectional view of the dispenser apparatus illustrated in FIG. 1 shown with the dispenser housing partially opened.

The dispenser apparatus 10 comprises a housing 12 that defines (FIG. 3) upper and lower compartments 14 and 16. As shown in FIG. 2, the housing 12 includes opposite end walls 18 and 20 and back and bottom walls 22 and 24, respectively, fixed between the end walls 18 and 20. Bottom rails 26 are provided on the bottom wall 24 for reasons more fully explained below, and a shelf 28 having therein holes 30 for condiment cups, straws, or the like (not shown) is mounted to end wall 18. The housing 12 also includes a top wall 32 in the interior of the housing 12 separating (see FIG. 3) the upper and lower compartments 14 and 16. To support the top wall 32 a pair of rails 34 and 36 are provided in the shelf 28 and an end wall 20, respectively. The rails 34 and 36 each define a slot 38 into which the top wall 32 is inserted, and locking clips 40 are provided in the back wall 22 to support the rear of the top wall 32. For reasons more fully explained below, the top wall 32 has (FIG. 6) a lip 42 that defines an opening 44. The housing 12 also includes a front wall 46 mounted on the bottom wall 24 by hinge members 48 or other suitable means. To permit and deny access to the lower compartment 16 the front wall 46 is moveable between an opened position (shown partially opened in FIG. 3) and a closed position (shown in FIG. 1). To gain and deny access to the upper compartment 14, a cover 50 is also provided. The cover 50 is mounted on the back wall 22 via a hinge 52 and is also moveable between an opened position (shown partially opened in FIG. 3) and a closed position (shown in FIG. 1).

Figure 5:
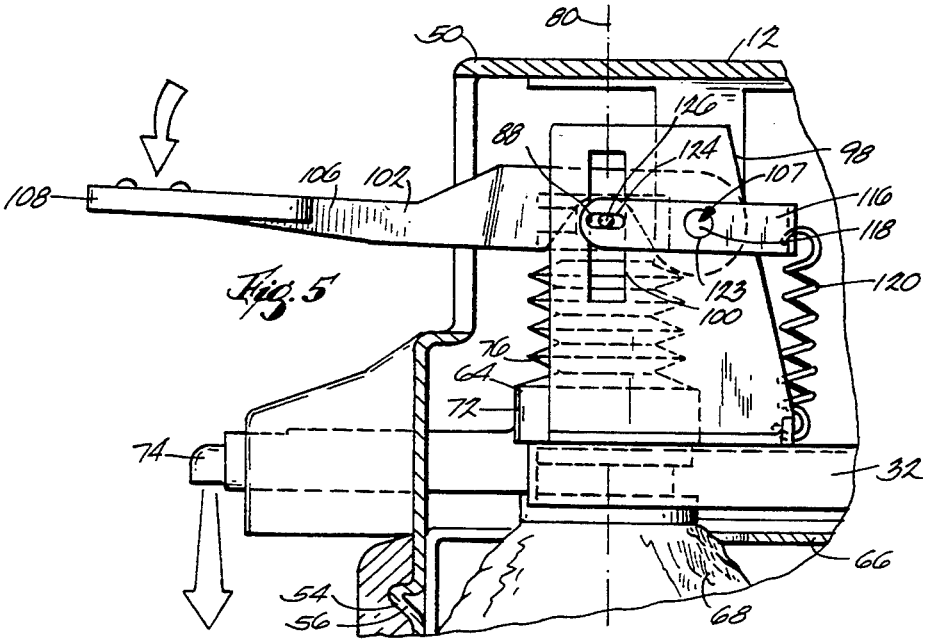
FIG. 5 is a view similar to FIG. 4 and shows the lever in a partially depressed position.
Figure 4:
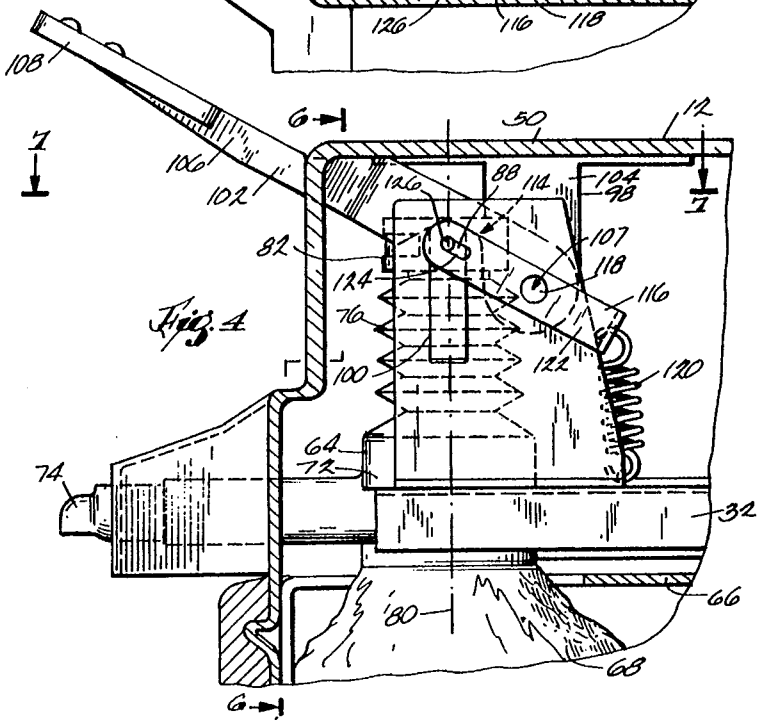
FIG. 4 is an enlarged, partially cross-sectional view of a portion of the dispenser apparatus illustrated in FIG. 1 which is shown with an actuating lever in a raised position.

To prevent opening of the cover 50 during use and tampering with the contents of the housing 12 generally, and to permit use of a single locking device (not shown) to lock both the front wall 46 and cover 50 closed, means are provided for preventing the cover 50 from moving from its closed position when the front wall 46 is also in its closed position. In the particular arrangement illustrated in the drawings, the means for preventing the cover 50 from moving from its closed position includes (FIG. 3) a groove 54 in the front wall 46, and a tongue 56 on the cover 50. As shown in FIGS. 4 and 5, the tongue 56 is received in the groove 54 when each of the cover 50 and front wall 46 are closed such that the cover 50 cannot be opened without at least partially opening the front wall 46 first.

The dispenser apparatus 10 also comprises a dispenser 60 including a replaceable container 62 with a pump apparatus 64 thereon. In the illustrated arrangement, the container 62 includes (FIG. 3) a cardboard box 66 containing a collapsible bag 68 filled with condiment, and the pump apparatus 64 is secured to the bag 68. When in service, the pump apparatus 64 extends through an opening in the box 66 and when not in use, the pump apparatus 64 can be folded within the box 66. When inserted into the housing 12, the container 62 fits into the lower compartment 16 between the bottom wall 24 and the top wall 32 and the pump apparatus 64 extends through the opening 44 in the top wall 32 and into the upper compartment 14.

As shown in FIGS. 4–7, the pump apparatus 64 includes a pumping mechanism for pumping condiment from the bag 68. While various suitable pumping mechanisms are available, in the illustrated embodiment the pumping mechanism is an inexpensive bellows pump 70. The bellows pump 70 includes a base 72 which overlays the lip 42 (see FIG. 6) to hold the pump apparatus 64 in an upright position on the top wall 32. The base 72 is attached to the bag 68, and a spout 74 is attached to the base 72 and extends outwardly from the housing 12. The bellows pump 70 also includes a bellows 76 extending upwardly from the base 72 and defining (FIG. 6) an interior pumping chamber 78. The bellows 76 is expandable and contractible along a pump axis 80 to draw condiment from the bag 68 into the pumping chamber 78 and to dispense condiment from the pumping chamber 78 through the spout 74.

In the arrangement illustrated, the pump apparatus 64 is fixed to the bag 68. Preferably, the pump apparatus 64 and bag 68 are obtained as a single unit, such as the unit marketed by Reseal Company (New York, N.Y.). While in the illustrated arrangement the pump apparatus 64 is fixed to the bag 68, in other arrangements (not shown) the pump apparatus 64 could be removable from the bag 68. For example, the pump apparatus 64 could, if desired, be provided with a threaded portion (not shown) that could be screwed on to a corresponding threaded portion (not shown) on the bag 68.

Figure 8:
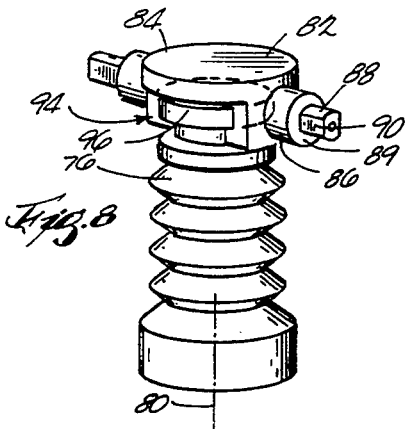
FIG. 8 is a perspective view of a portion of the pump apparatus illustrated in FIGS. 4–7.
Figure 9:
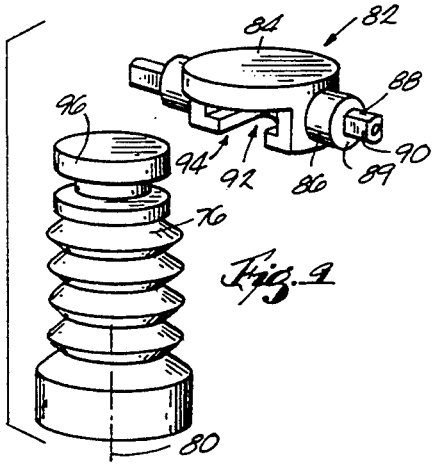
FIG. 9 is an exploded perspective view of the arrangement illustrated in FIG. 8.

The dispenser apparatus 10 also includes means for actuating the pump apparatus 64. In the illustrated embodiment, the means for actuating the pump apparatus 64 includes a pump actuating member 82, the vertical movement of which will activate the bellows pump 70. As shown most clearly in FIGS. 8 and 9, the pump actuating member 82 includes a mounting member or cap 84 having a pair of projections 86 each including a peg portion 88 and an outwardly facing shoulder 89. Each peg portion 88 has opposite lands 90 for reasons more fully explained below. The mounting cap 84 defines a cavity 92 having a generally T-shaped profile and an opening 94. The pump actuating member 82 also includes a cooperating disk 96 that is mounted on top of the bellows 76. The disk 96 is receivable within the mounting cap 84 for movement therewith. The disk 96 is preferably sized somewhat larger than the opening 94, so that the disk 96 is insertable in snap-fit relation into the cavity 92.

The means for actuating the pump apparatus 64 also includes means for supporting the pump actuating member 82 for linear movement in the direction of the pump axis 80 (i.e., vertical movement in the illustrated arrangement). While various means for supporting the pump actuating member 82 can be employed, in the illustrated arrangement the supporting means includes a pair of spaced apart brackets 98 on opposite sides of the opening 44 in the top wall 32. The brackets 98 are provided with means for limiting movement of the pump actuating member 82 to only linear movement in the direction of the pump axis 80. In the illustrated arrangement, the limiting means includes an elongated vertical slot 100 in each bracket 98. The peg portion 88 of each of the projections 86 is received in one of the vertical slots 100, and the lands 90 cooperate with the edges of the slots 100 to prevent pivotal movement of the pump actuating member 82 and to otherwise limit movement of the pump actuating member 82 to linear (i.e., upward and downward) movement parallel to the pump axis 80. The shoulders 89 of the projections 86 cooperate with the brackets 98 to prevent lateral movement of the pump actuating member 82.

Figure 7:
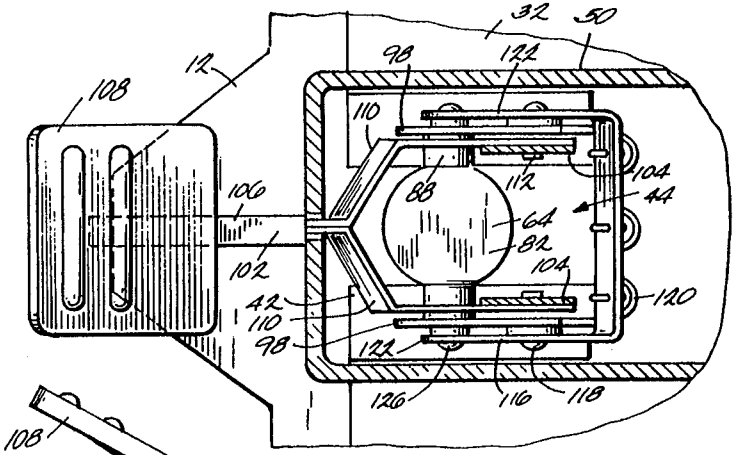
FIG. 7 is a top view taken generally along line 7—7 in FIG. 4.
Figure 6:
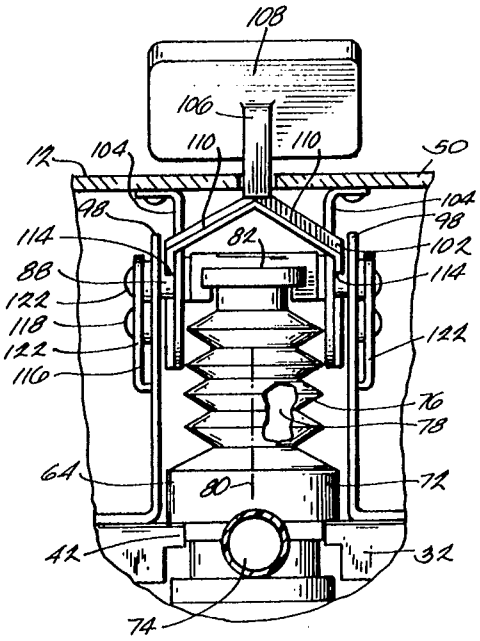
FIG. 6 is a front view, partially broken away, and taken generally along line 6—6 in FIG. 4.

The means for actuating the pump apparatus 64 also includes means for moving the pump actuating member 82. While other means for moving the pump actuating member can be employed, in the illustrated arrangement the moving means is operable to selectively depress the pump actuating member 82 to contract the bellows 76 and includes a lever assembly 102. The lever assembly 102 includes (FIG. 3) a pair of brackets 104 fixed to the underside of the cover 50 and a lever 106 mounted on the brackets 104 for pivotal movement about a horizontal axis 107. As shown in FIGS. 6 and 7, the lever 106 is generally Y-shaped and includes a paddle portion 108 engageable by an operator and an opposite yoke-shaped portion having arms 110 each attached to one of the brackets 104 by a pivot pin 112.

To operate the pump apparatus 82 in response to pivotal lever movement, the lever 106 is provided with lost motion means for imparting movement to the pump actuating member 82 without also moving the pump actuating member 82 in a nonlinear manner. In the illustrated arrangement, the lost motion means includes a downwardly facing arcuate slide surface 114 on each of the arms 110.

When the cover 50 is closed, the slide surfaces 114 are automatically brought into engagement with the peg portions 88 of the pump actuating member 82. When the lever 106 is depressed by an operator, the peg portions 88 slide along the slide surfaces 114, causing the pump actuating member 82 to move downwardly to contact the bellows 76 to dispense condiment. The arcuate slide surfaces 114 are preferably capable of moving the peg portions 88 along substantially the entire extent of the vertical slots 100 without imparting pivotal movement to the pump actuating member 82. When the cover 50 is moved to its opened position the lever 106 is automatically raised therewith and disengaged from the pump actuating member 82.

To move the pump actuating member 82 upwardly to expand the bellows 76 following a downward stroke of the lever 106, the means for actuating movement of the pump actuating member 82 is provided with means for biasing the pump actuating member 82 upwardly. In the illustrated embodiment, the means for biasing the pump actuating member 82 upwardly includes a pivot member 116 pivotally mounted on the brackets 98 via pivot pins 118 extending through pivot apertures 119, and three springs 120 attached between the pivot member 116 and the top wall 32. The pivot member 116 includes a pair of spaced apart arms 122 each including a pivot aperture 123 through which a pivot pin 118 extends and an elongated lost motion slot 124. Screws 126 (FIG. 3) extend through the lost motion slots 124 to attach the arms 122 to the peg portions 88. When the lever 106 is released after being depressed, the springs 120 not only raise the pump actuating member 82, but also pivot the lever 106 back to its initial raised position so that it is again immediately operable to dispense another serving of condiment.

Advantageously, when the bag 68 is empty, the front wall 46 and the cover 50 are opened, the disk 96 is unsnapped from the mounting cup 84, and the dispenser 60 is removed from the housing 12 without mess. The empty dispenser 60 is then discarded and replaced with a full dispenser by sliding the full dispenser into the housing 12, snapping the disk 96 of the new dispenser 46 into the mounting cap 84, and closing the front wall 46 and cover 50. With the cover 50 closed, the lever 106 is brought automatically into operable engagement with the pump apparatus 64 to dispense condiment when desired.

Other features and advantages of the invention are set forth in the following claims.

I claim:

1. A dispenser apparatus for dispensing a fluid material, said dispenser apparatus comprising a housing defining a compartment, said housing including a cover moveable between an opened position and a closed position, a replaceable container for a fluid material, said container being insertable into said compartment, a pump apparatus attached to said container for pumping the fluid material out of said container, and means for actuating said pump apparatus, said means for actuating said pump apparatus including a manually operable lever supported on said cover for pivotal movement relative thereto, said lever being automatically operably engaged with said pump apparatus when said cover is moved to said closed position, and said lever being automatically disengaged from said pump apparatus when said cover is moved to said opened position, whereby said lever, when operably engaged with said pump apparatus, is pivotally moveable to actuate said pump apparatus to dispense the fluid material.

2. A dispenser apparatus as set forth in claim 1 wherein said pump apparatus includes a pump actuating member supported on said housing for linear movement relative thereto, and wherein said lever engages said pump actuating member when said cover is in said closed position.

3. A dispenser apparatus as set forth in claim 2 and further including means for limiting movement of said pump actuating member to linear movement in a first direction and in a second direction opposite said first direction.

4. A dispenser apparatus as set forth in claim 3 wherein said lever is engageable with said pump actuating member for sliding movement relative thereto responsive to pivotal movement of said lever.

5. A dispenser apparatus as set forth in claim 3 wherein said lever is operable to impart movement to said pump actuating member in said first direction, and wherein said means for actuating said pump apparatus includes means for biasing said pump actuating member in said second direction.

6. A dispenser apparatus for dispensing a food product, said dispenser apparatus comprising a housing, a container for a food product, said container being insertable into said housing, a pump apparatus attached to said container, said pump apparatus including an axis, and a pump actuating member, means for supporting said pump actuating member on said housing for linear movement parallel to said axis, said means for supporting said pump actuating member including means for limiting movement of said pump actuating member to said linear movement, and means for moving said pump actuating member, said means for moving said pump actuating member including a manually operable lever supported on said housing for pivotal movement relative thereto, said lever including lost motion means for imparting linear movement to said pump actuating member responsive to pivotal movement of said lever.

7. A dispenser apparatus as set forth in claim 6 wherein said pump apparatus includes a bellows defining a pumping chamber, said bellows being expandable to draw the food product from said container into said pumping chamber, and said bellows being contractible to expel the food product from said pumping chamber, and wherein said pump actuating member is supported on said bellows so that said linear movement of said pump actuating member causes said bellows to expand and contract.

8. A dispenser apparatus as set forth in claim 6 wherein said lost motion means for imparting linear movement to said pump actuating member includes a slide surface on said lever, said slide surface being engageable with said pump actuating member for sliding movement relative thereto responsive to pivotal movement of said lever.

9. A dispenser apparatus as set forth in claim 8 wherein said housing includes a cover moveable between an opened position and a closed position, said lever being supported on said cover for pivotal movement, wherein said slide surface engages said pump actuating member when said cover is in its closed position, and wherein said slide surface is disengaged from said pump actuating member when said cover is in its opened position.

10. A dispenser apparatus as set forth in claim 8 wherein said lever is operable to impart linear movement to said pump actuating member in a first direction parallel to said axis, and wherein said means for moving said pump actuating member includes means for imparting movement to said pump actuating member in a second direction opposite said first direction.

11. A dispenser apparatus as set forth in claim 6 wherein said means for supporting said pump actuating member for linear movement includes a bracket supported on said housing, and a projection extending from said pump actuating member, and wherein means for limiting movement of said pump actuating member to linear movement includes a slot in said bracket, said slot being elongated in a direction parallel to said axis, and said projection being received in said slot.

12. A dispenser apparatus as set forth in claim 11 wherein said lost motion means for imparting linear movement to said pump actuating member includes a slide surface on said lever, said slide surface being engageable with said projection for sliding movement relative thereto responsive to pivotal movement of said lever.

13. A dispenser apparatus comprising a housing, a dispenser insertable into said housing, said dispenser including a container for a fluid material, and a pump apparatus attached to said container for pumping the fluid material out of said container, said pump apparatus including a bellows defining a pumping chamber, said bellows being expandable to draw the fluid material from said container into said pumping chamber, said bellows being contractible to expel the fluid material from said pumping chamber, said pump apparatus including a pump actuating member, said pump actuating member being mounted on said bellows, said pump actuating member being movable in a first direction to cause said bellows to contract, and said pump actuating member being movable in a second direction to cause said bellows to expand, a guide member mounted on said housing, said guide member supporting said pump actuating member for linear movement in a first direction and in a second direction opposite said first direction, and said guide member limiting movement of said pump actuating member to movement in said first and second directions, a manually operable lever supported on said housing for pivotal movement relative thereto, said lever being pivotable to impart linear movement to said pump actuating member in said first direction only, and means for biasing said pump actuating member in said second direction and into engagement with said lever.

14. A dispenser apparatus as set forth in claim 13 wherein said housing includes a cover moveable between an opened position and a closed position, said lever being supported on said cover for pivotal movement, wherein said lever engages said pump actuating member when said cover is in said closed position, and wherein said lever is disengaged from said pump actuating member when said cover is in said opened position.

15. A dispenser apparatus as set forth in claim 13 wherein said lever includes an arcuate slide surface engageable with said pump actuating member for sliding movement relative thereto responsive to pivotal movement of said lever.

16. A dispenser apparatus as set forth in claim 13 wherein said guide member includes a bracket mounted on said housing, said bracket including an elongated slot, and wherein said pump actuating member includes a mounting member, said mounting member including a projection extending through said elongated slot, and said mounting member defining a cavity and an opening communicating with said cavity, and a disk member, said disk member being sized larger than said opening so that said disk member is insertable in snap-fit relation into said cavity.

17. A condiment dispenser apparatus comprising a housing defining upper and lower compartments, said housing including a top wall separating said upper and lower compartments, said top wall having a lip defining an opening, a front wall moveable between an opened position in which access to said lower compartment is permitted, and a closed position in which access to said lower compartment is denied, and a cover moveable between an opened position in which access to said upper compartment is permitted, and a closed position in which access to said upper compartment is denied, a replaceable condiment dispenser including a collapsible bag for containing condiment, said collapsible bag being insertable into said lower compartment, and a pump apparatus extending upwardly through said opening in said top wall and into said upper compartment, said pump apparatus including a spout through which condiment is dispensed, said spout extending outwardly from said housing, a bellows pump attached to said collapsible bag, said bellows pump including a bellows defining a pumping chamber, said bellows being expandable to draw condiment from said collapsible bag into said pumping chamber, and contractible to expel condiment from said pumping chamber through said spout, and a pump actuating member including a mounting member defining a cavity, said mounting member including a pair of projections, and said pump actuating member including a disk removably received in said cavity, said disk being supported on said bellows, means for supporting said pump actuating member for vertical movement, said means for supporting said pump actuating member including a pair of spaced apart brackets on opposite sides of said opening in said top wall, said brackets extending upwardly from said top wall, and each of said brackets including an elongated vertical slot, each of said projections extending through one of said bracket vertical slots, and manual means for moving said pump actuating member, said manual means for moving said pump actuating member including means for selectively depressing said pump actuating member to contract said bellows, said means for selectively depressing said pump actuating member including a manually operable lever mounted on said cover for pivotal movement about a horizontal axis, said lever including a pair of downwardly facing arcuate slide surfaces, each of said projections being automatically engaged by one of said arcuate slide surfaces for sliding movement therealong when said cover is moved to its closed position, and means for biasing said pump actuating member upwardly to expand said bellows, said means for biasing said pump actuating member upwardly including a pivot member pivotally mounted on said brackets, said pivot member including a pair of spaced apart arms, each of said arms including an elongated slot, each of said projections extending through one of said arm elongated slots, and a spring extending between said pivot member and said top wall.

18. A condiment dispenser apparatus as set forth in claim 17 wherein said front wall includes a groove, and said cover includes a tongue, said tongue being received in said groove when each of said cover and said front wall are in their respective closed positions to prevent said cover from moving from its closed position when said front wall is also in its closed position.

19. A condiment dispenser apparatus as set forth in claim 17 wherein said disk is removably received in snap-fit relation in said pump actuating member.

* * * * *